US007337478B1

(12) United States Patent
Lake

(10) Patent No.: US 7,337,478 B1
(45) Date of Patent: Mar. 4, 2008

(54) HOSPITAL BED SYSTEMS

(76) Inventor: Joyce A. Lake, 503 E. Wagoner Rd., Phoenix, AZ (US) 85022-1054

( * ) Notice: Subject to any disclaimer, the term of this patent is extended or adjusted under 35 U.S.C. 154(b) by 164 days.

(21) Appl. No.: 11/330,976

(22) Filed: Jan. 11, 2006

Related U.S. Application Data

(60) Provisional application No. 60/643,250, filed on Jan. 11, 2005.

(51) Int. Cl.
*A61G 7/10* (2006.01)

(52) U.S. Cl. ..... 5/81.1 C; 5/81.1 R

(58) Field of Classification Search ..... 5/81.1 C, 5/81.1 HS, 81.1 R, 922
See application file for complete search history.

(56) References Cited

U.S. PATENT DOCUMENTS

| | | | | |
|---|---|---|---|---|
| 2,827,642 | A | 3/1958 | Huff | |
| 3,810,263 | A * | 5/1974 | Taylor et al. | 5/81.1 C |
| 4,109,329 | A | 8/1978 | Tupper | |
| 4,369,533 | A | 1/1983 | Gisiger | |
| 4,459,712 | A | 7/1984 | Pathan | |
| 4,679,787 | A | 7/1987 | Guilgault | |
| 4,970,738 | A * | 11/1990 | Cole | 5/81.1 C |
| 5,390,379 | A * | 2/1995 | Palmer et al. | 5/81.1 C |
| 6,282,734 | B1 | 9/2001 | Holberg | |
| 6,363,555 | B1 | 4/2002 | LaRose | |
| 6,496,991 | B1 | 12/2002 | Votel | |
| 6,499,156 | B1 | 12/2002 | Dirst | |
| 6,611,974 | B2 * | 9/2003 | Roit et al. | 5/81.1 C |
| 6,662,388 | B2 | 12/2003 | Friel et al. | |
| 6,772,456 | B2 | 8/2004 | Votel | |
| 2001/0020304 | A1 * | 9/2001 | Roit et al. | 5/611 |
| 2002/0023297 | A1 | 2/2002 | Khait | |

* cited by examiner

*Primary Examiner*—Robert G. Santos
(74) *Attorney, Agent, or Firm*—Stoneman Volk Patent Group; Martin L. Stoneman; Michael D. Volk, Jr.

(57) ABSTRACT

A system for mechanically assisted repositioning of a bed-ridden patient within a hospital-type bed equipped with a moving mattress pad driven by an electric motor. The mattress pad is formed into a continuous loop disposed over a plurality of support and drive rollers. The system is adaptable to existing hospital beds.

18 Claims, 7 Drawing Sheets

HOSPITAL BED SYSTEMS

CROSS-REFERENCE TO RELATED APPLICATION

The present application is related to and claims priority from prior provisional application Ser. No. 60/643,250, filed Jan. 11, 2005, entitled "TREADMILL HOSPITAL BED", the content of which is incorporated herein by this reference and is not admitted to be prior art with respect to the present invention by the mention in this cross-reference section.

BACKGROUND

This invention relates to providing a system for improved management of weak patients, especially invalid patients and other bed-ridden individuals having limited independent mobility. More particularly, this invention relates to providing a system for assisted and unassisted movement of an individual within a hospital bed.

In general, the care of bed-confined individuals having limited independent mobility is a physically demanding task. Often, the movement of the patient within the bed requires strenuous, often dangerous, lifting of the patient by one or more caregivers. Management of the bariatric patient is especially difficult, often requiring several individuals working together to reposition the patient from a prone to a comfortably inclined position. Furthermore, the inclined individual has a tendency to gradually slide downwardly into an uncomfortable position requiring periodic repositioning, frequently requiring, for heavier patients, the muscles of several caregivers. Therefore, a need exists for easy-to-use, economical, and durable systems providing assistance in repositioning of bed-confined individuals, thus reducing stress imposed on the patients, nurses, caregivers, or anyone providing care to the patient.

OBJECTS AND FEATURES OF THE INVENTION

A primary object and feature of the present invention is to provide a system to overcome the above-described problems.

Another primary object and feature of the present invention is to provide a system for mechanically-assisted repositioning of a bed-confined patient within a hospital-type bed.

It is a further object and feature of the present invention to provide such a system that is retrofitted to existing hospital-type beds.

It is another object and feature of the present invention to provide such a system adaptable for use in nursing homes, hospitals, and private care homes.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a system, related to mechanically-assisted movement of at least one individual supported upon at least one hospital-type bed-frame having at least one head portion, at least one foot portion, and at least one intermediate portion, such system comprising: at least one resilient pad adapted to comfortably support the at least one individual; wherein such at least one resilient pad comprises at least one essentially continuous loop having at least one first loop terminus adapted to reside adjacent the at least one head portion and at least one second loop terminus adapted to reside adjacent the at least one foot portion; at least one first support adapted to support such at least one first loop terminus; at least one second support adapted to support such at least one second loop terminus; at least one third support adapted to support such at least one resilient pad adjacent the at least one intermediate portion; wherein at least one of such at least one first support, such at least one second support, and such at least one third support is adapted to rotatably drive such at least one essentially continuous loop along at least one path extending substantially between the at least one head portion and the at least one foot portion of the at least one hospital-type bed-frame.

Moreover, it provides such a system further comprising: at least one motor-driven rotator adapted to rotatably drive at least one of such at least one first support, such at least one second support, and such at least one third support; and at least one controller adapted to control the operation of such at least one motor-driven rotator. Additionally, it provides such a system wherein: such at least one first support comprises at least one first rolling support adapted to rotatably support such at least one first loop terminus; and such at least one second support comprises at least one second rolling support adapted to rotatably support such at least one second loop terminus.

Also, it provides such a system wherein such at least one third support comprises at least one third rolling support adapted to rotationally support such at least one resilient pad. In addition, it provides such a system wherein: such at least one first rolling support, such at least one second rolling support, and such at least one third rolling support each comprise at least one substantially cylindrical member having at least one first end and at least one second end; such at least one first end and such at least one second end each comprise at least one bearing adapted to provide rotatable support of such at least one substantially cylindrical member; and such at least one bearing is adapted to be rigidly mountable to the at least one hospital-type bed-frame.

And, it provides such a system further comprising: at least one essentially endless belt adapted to fit within such at least one essentially continuous loop of such at least one resilient pad; and at least one removable attacher adapted to removeably attach such at least one resilient pad to such at least one essentially endless belt; wherein such at least one essentially endless belt is adapted to movably engage such at least one first support and such at least one second support. Further, it provides such a system wherein such at least one essentially endless belt comprises at least one width and at least one length substantially matching that of such at least one essentially continuous loop.

Even further, it provides such a system further comprising: at least one hospital-type bed comprising such at least one hospital-type bed-frame; wherein such at least one hospital-type bed-frame comprises at least one adjustable articulation having at least one raised adjusted position and at least one lowered adjusted position. Moreover, it provides such a system wherein such at least one controller comprises at least one operation limiter adapted to limit the operation of such at least one motor-driven rotator when such at least one hospital-type bed-frame is adjusted to such raised adjusted position. Additionally, it provides such a system wherein such at least one controller comprises at least one manual control adapted to provide manual control of such at least one motor-driven rotator.

In accordance with another preferred embodiment hereof, this invention provides a system, related to mechanically-assisted movement of at least one individual supported upon at least one hospital-type bed-frame having at least one substantially rectangular-shaped periphery comprising least one head portion, at least one foot portion, and at least one intermediate portion extending there between, such system comprising: at least one resilient pad adapted to comfortably support the at least one individual; wherein such at least one resilient pad comprises at least one essentially continuous loop having at least one first loop terminus adapted to reside adjacent the at least one head portion and at least one second loop terminus adapted to reside adjacent the at least one foot portion; at least one first rolling support, having at least one first axis of rotation, adapted to rotatably support such at least one first loop terminus; at least one second rolling support, having at least one second axis of rotation, adapted to rotatably support such at least one second loop terminus; at least one third rolling support, having at least one third axis of rotation, adapted to rotationally support such at least one resilient pad adjacent the at least one intermediate portion; wherein such at least one first axis of rotation, such at least one second axis of rotation, and such at least one third axis of rotation are aligned substantially parallel with the at least one head portion and the at least one foot portion of the at least one substantially rectangular-shape periphery; and wherein at least one of such at least one first rolling support, such at least one second rolling support, and such at least one third rolling support is adapted to rotatably drive such at least one essentially continuous loop along at least one path of movement substantially perpendicular to such at least one second axis of rotation, and such at least one third axis of rotation.

In addition, it provides such a system further comprising: at least one motor-driven rotator adapted to rotatably drive at least one of at least one of such at least one first rolling support, such at least one second rolling support, and such at least one third rolling support; and at least one controller adapted to control the operation of such at least one motor-driven rotator; wherein such at least one controller comprises at least one manual control adapted to provide manual control of such at least one motor-driven rotator. In addition, it provides such a system wherein such at least one motor-driven rotator is adapted to rotatably drive such at least one first rolling support. And, it provides such a system further comprising: at least one essentially endless belt adapted to operate within the at least one essentially continuous loop of such at least one resilient pad; and at least one removable attacher adapted to removeably attach such at least one resilient pad to such at least one essentially endless belt; wherein such at least one essentially endless belt is adapted to directly engage such at least one first rolling support and such at least one second rolling support.

Further, it provides such a system wherein: such at least one first rolling support, such at least one second rolling support, and such at least one third rolling support each comprise at least one substantially cylindrical member having at least one first end and at least one second end; such at least one first end and such at least one second end each comprise at least one bearing adapted to provide free rotation of such at least one substantially cylindrical member; and such at least one bearing is adapted to be mountable to the at least one hospital-type bed-frame. Even further, it provides such a system further comprising: such at least one hospital-type bed comprising at least one hospital-type bed-frame; wherein such at least one hospital-type bed-frame comprises such at least one head portion, such at least one foot portion, and such at least one intermediate portion; and wherein such at least one hospital-type bed-frame comprises at least one adjustable articulation having at least one raised adjusted position and at least one lowered adjusted position. Even further, it provides such a system wherein such at least one controller comprises at least one operation limiter adapted to limit the operation of such at least one motor-driven rotator when such at least one hospital-type bed-frame comprises such at least one raised configuration.

In accordance with another preferred embodiment hereof, this invention provides a method, related to mechanically-assisted movement of at least one individual supported upon at least one hospital-type bed-frame having at least one head portion, at least one foot portion, and at least one intermediate portion, comprising the steps of: providing at least one resilient pad adapted to comfortably support the at least one individual arranging such at least one resilient pad to comprises at least one essentially continuous loop having at least one first loop terminus adapted to reside adjacent the at least one head portion and at least one second loop terminus adapted to reside adjacent the at least one foot portion; providing at least one first support adapted to support such at least one first loop terminus; providing at least one second support adapted to support such at least one second loop terminus; providing at least one third support adapted to support such at least one resilient pad adjacent the at least one intermediate portion; mounting each of such at least one first support, such at least one second support, and such at least one third support to the at least one hospital-type bed-frame; providing at least one motor-driven rotator adapted to rotatably drive at least one of such at least one first support, such at least one second support, and such at least one third support; and using such motor-driven rotator to rotate at least one of such at least one first support, such at least one second support, and such at least one third support to rotatably drive such at least one essentially continuous loop along at least one path extending substantially between the at least one head portion and the at least one foot portion of the at least one hospital-type bed-frame; wherein such at least one essentially continuous loop while rotatably driven is adapted to provide such mechanically-assisted movement of at least one individual supported upon such at least one hospital-type bed-frame.

Even further, it provides such a method further comprising the step of providing at least one controller adapted to control the operation of such at least one motor-driven rotator. Even further, it provides such a method further comprising the initial step of providing at least one the at least one hospital-type bed comprising the at least one hospital-type bed-frame.

DETAILED DESCRIPTION OF THE BEST MODES AND PREFERRED EMBODIMENTS OF THE INVENTION

Figure 1:
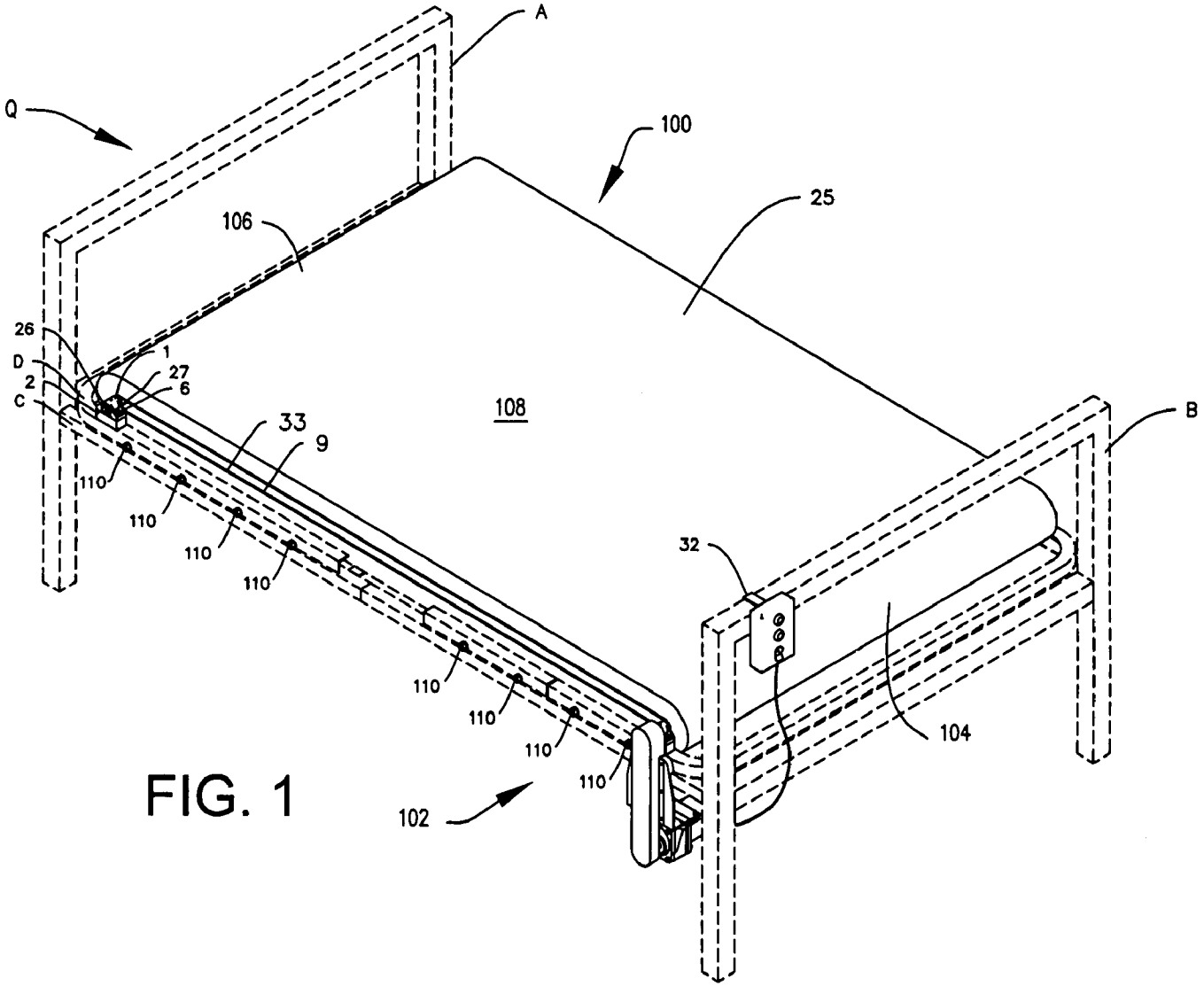
FIG. 1 shows a perspective view of an existing hospital bed modified to comprise a patient positioning unit of a hospital bed system in accordance with a preferred embodiment of the present invention.

FIG. 1 shows a perspective view of a hospital bed modified to comprise patient positioning unit 102 of hospital bed system 100 in accordance with a preferred embodiment of the present invention. Patient positioning unit 102 preferably comprises a uniquely configured mattress pad having a movable upper support surface 108 adapting to assist a caregiver in maneuvering an individual confined within a hospital-type bed. Turning now to the drawings, in which like reference characters indicate corresponding elements throughout the several views, attention is directed to FIG. 1 in which is seen a perspective view of a modified hospital bed, identified herein by the reference letter Q, shown in a flat laying position. Preferably, hospital bed Q has been modified to comprise patient positioning unit 102 of the hospital bed system 100, as shown.

The depicted hospital bed Q of FIG. 1 is representative of commercially available beds used in patient care, having one or more articulating features adapted to assist in raising and lowering a patient from flat laying positions to semi-inclined (sitting) or leg-elevated position. For clarity, structures and components of hospital bed Q that are independent of the retrofittable embodiments of the present invention are indicated by a dashed-line depiction.

Preferably, hospital bed Q comprises a generally rectangular peripheral shape having two generally parallel side portions adjoining two generally parallel end portions, as shown. Preferably, one end portion comprises a foot portion, identified herein by the reference letter A, with the second end portion comprising a head portion, identified herein by the reference letter B, as shown. Preferably, each side portion spanning the intermediate distance between foot portion A and head portion B comprises a structural frame assembly, most preferably a frame assembly comprising fixed frame portion C and articulating frame portions D, as shown. Preferably, each articulating frame portion D is pivotally mounted to fixed frame portion C to enable a raised (inclined) positioning of the support mattress and a lowered (flat) positioning of the support mattress as illustrated in FIG. 1 (at least embodying herein at least one hospital-type bed comprising such at least one hospital-type bed-frame, wherein such at least one hospital-type bed-frame comprises at least one adjustable articulation having at least one raised adjusted position and at least one lowered adjusted position). Upon reading the teachings of this specification, those of ordinary skill in the art will now understand that, under appropriate circumstances, considering such issues as intended use, bed manufacturer, bed model, etc., other suitable bed arrangements, such as, for example, utilizing beds comprising side rails, beds without articulating features, beds comprising custom designs, etc., may suffice.

Unless noted otherwise, the following numerically referenced components indicate preferred structures and arrangements of patient positioning unit 102 of the hospital bed system 100. As previously indicated, preferred embodiments of hospital bed system 100 comprise patient positioning unit 102 retrofitted to an existing hospital bed Q, as shown. Alternate preferred embodiments of hospital bed system 100 comprise patient positioning unit 102 as an integrated (factory supplied) component of hospital bed Q.

Preferably, mattress pad 25 of patient positioning unit 102 is situated over endless belt 9, as shown. Preferably, mattress pad 25 (at least embodying herein at least one resilient pad adapted to comfortably support the at least one individual) comprises a generally rectangular pad formed into a continuous loop, preferably extending between foot portion A and head portion B, as shown. Preferably, the continuous loop of mattress pad 25 comprises first loop terminus 104 adapted to reside adjacent head portion B and second loop terminus loop 106 adapted to reside adjacent foot portion A, as shown. Each terminus loop preferably comprises a transitioning turn of about 180°, as shown. Upon reading the teachings of this specification, those of ordinary skill in the art will now understand that, under appropriate circumstances, considering such issues as intended use, design preference, etc., other mattress pad features and arrangements, such as, for example, providing a fastener arrangement at each end of the mattress pad to assist in forming and maintaining such an essentially continuous loop, etc., may suffice.

Preferably, while configured to form such a continuous loop, mattress pad 25 comprises a physical size compatible with operational requirements of hospital bed Q (e.g. generally matching the size of the original flat mattress of the bed manufacturer).

Preferably, mattress pad 25 comprises a substantially resilient construction adapted to provide comfortable bodily support for extended periods. Preferably, mattress pad 25 comprises a flexible outer cover encapsulating a flexible and resilient interior core material. Preferably, substantially entire length of mattress pad 25 is adapted to flexibly bend to facilitate the formation of first loop terminus 104 and second loop terminus 106 during operation, as shown.

Preferably, mattress pad 25 is wrapped around endless belt 9, with the interior of the continuous loop of mattress pad 25 preferably joined to exterior surface of endless belt 9, as shown. Preferably, mattress pad 25 is removably fastened to endless belt 9 using at least one removable fastener, most preferably hook-and-loop fastener 33, as shown. Preferably, endless belt 9 (at least embodying herein at least one essentially endless belt adapted to operate within the at least one essentially continuous loop of such at least one resilient pad) is adapted to be retained on hospital bed Q in a semi-permanent manner, while mattress pad 25 is adapted to be removable, on a more frequent basis, for cleaning and replacement. Preferably, the two interlocking surfaces of hook-and-loop fastener 33 are applied along the peripheral underside edges of mattress pad 25, and the peripheral upper-side edges of endless belt 9, respectively, as shown. Preferred removable fasteners suitable for use as hook-and-loop fastener 33 include products manufactured under the Velcro™ brand name. Upon reading the teachings of this specification, those of ordinary skill in the art will now understand that, under appropriate circumstances, considering such issues as intended use, cost, design preference, etc., other fastener arrangements, such as, for example, mechanical snaps, zippers, straps, adhesives, etc., may suffice.

Furthermore, upon reading the teachings of this specification, those of ordinary skill in the art will now understand that, under appropriate circumstances, considering such issues as intended use, cost, design preference, etc., other mattress/belt arrangements, such as, for example, making the belt an integral part of the mattress (pad), driving the pad in its loop more directly, etc., may suffice. Preferably, endless belt 9 (or, under appropriate circumstances, combination pad/belt) is rotationally supporting by drive shaft 10 and by a free-wheeling bearing shaft 27 located at the foot and head of hospital bed Q respectively, as shown.

Directing attention to the foot portion A of hospital bed Q, FIG. 1 shows a preferred spacer 2 preferably supporting pillow block 1 that is preferably mounted to frame D, as shown. Preferably, bearing shaft 27 comprises a substantially cylindrical-shaped member, as shown. Preferably, bearing shaft 27 (at least embodying herein at least one second support adapted to support such at least one second loop terminus and at least embodying herein at least one second rolling support) is situated within pillow block 1 and is held in place by at least one removable retainer, most preferably snap ring 26, as shown. Preferably, pillow block 1 is mounted to articulating frame portions D to position the rotational axis of bearing shaft 27 (at least embodying herein at least one second axis of rotation) in a substantially parallel alignment with foot portion A and head portion B. The above-described bearing and retainer arrangement allows free rotation of bearing shaft 27, thus the rotation of endless belt 9 and mattress pad 25 disposed thereon.

Preferably, the bottom of mattress pad 25 (spanning the intermediate distance between drive shaft 10 and bearing shaft 27) is preferably supported by a plurality of intermediate roller shaft assemblies, most preferably by about eight intermediate roller shaft assemblies identified herein by the assembly reference number 110.

Figure 4:
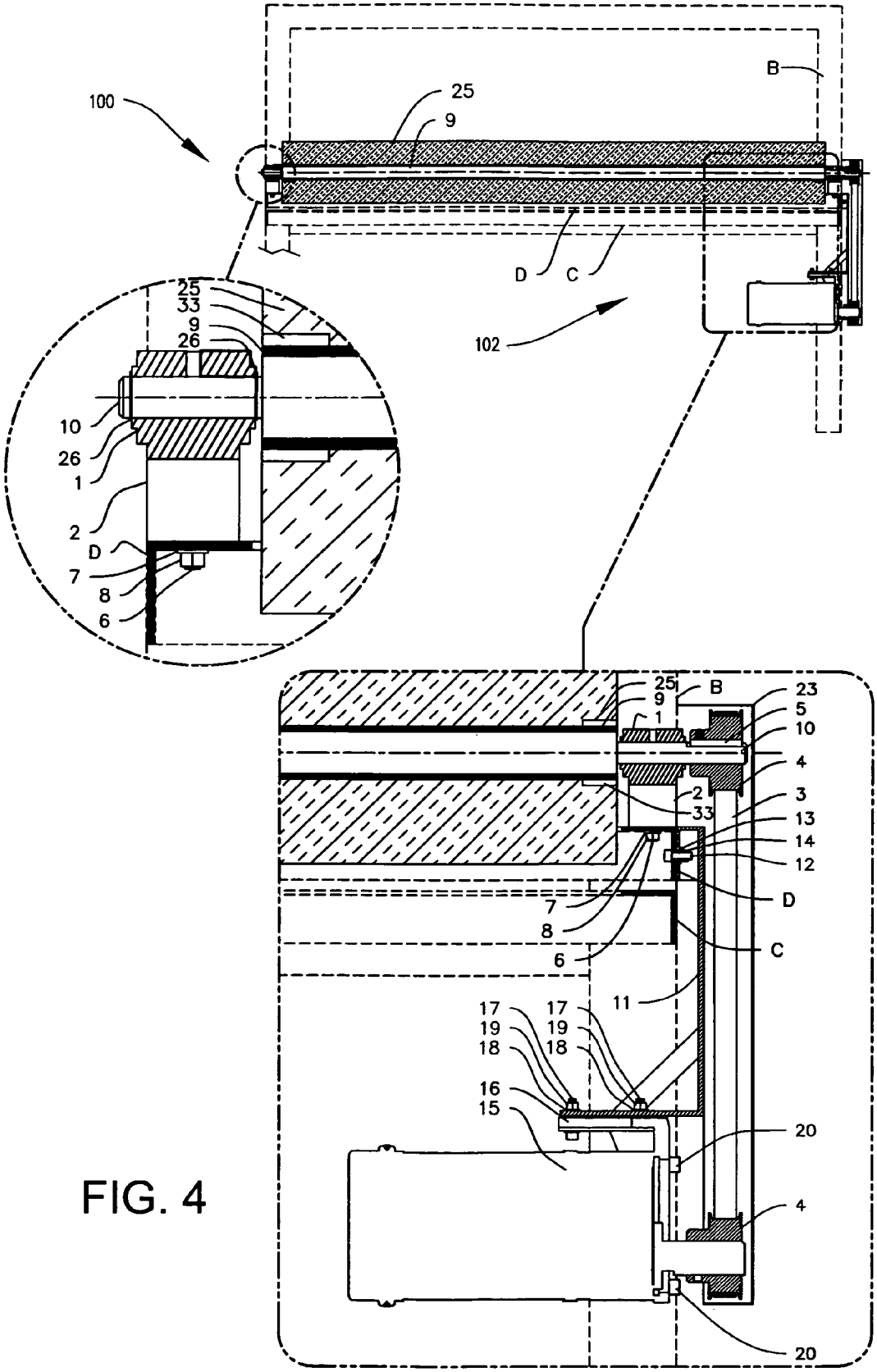
FIG. 4 shows a vertical sectional view of section 4-4 of FIG. 3.
Figure 5:
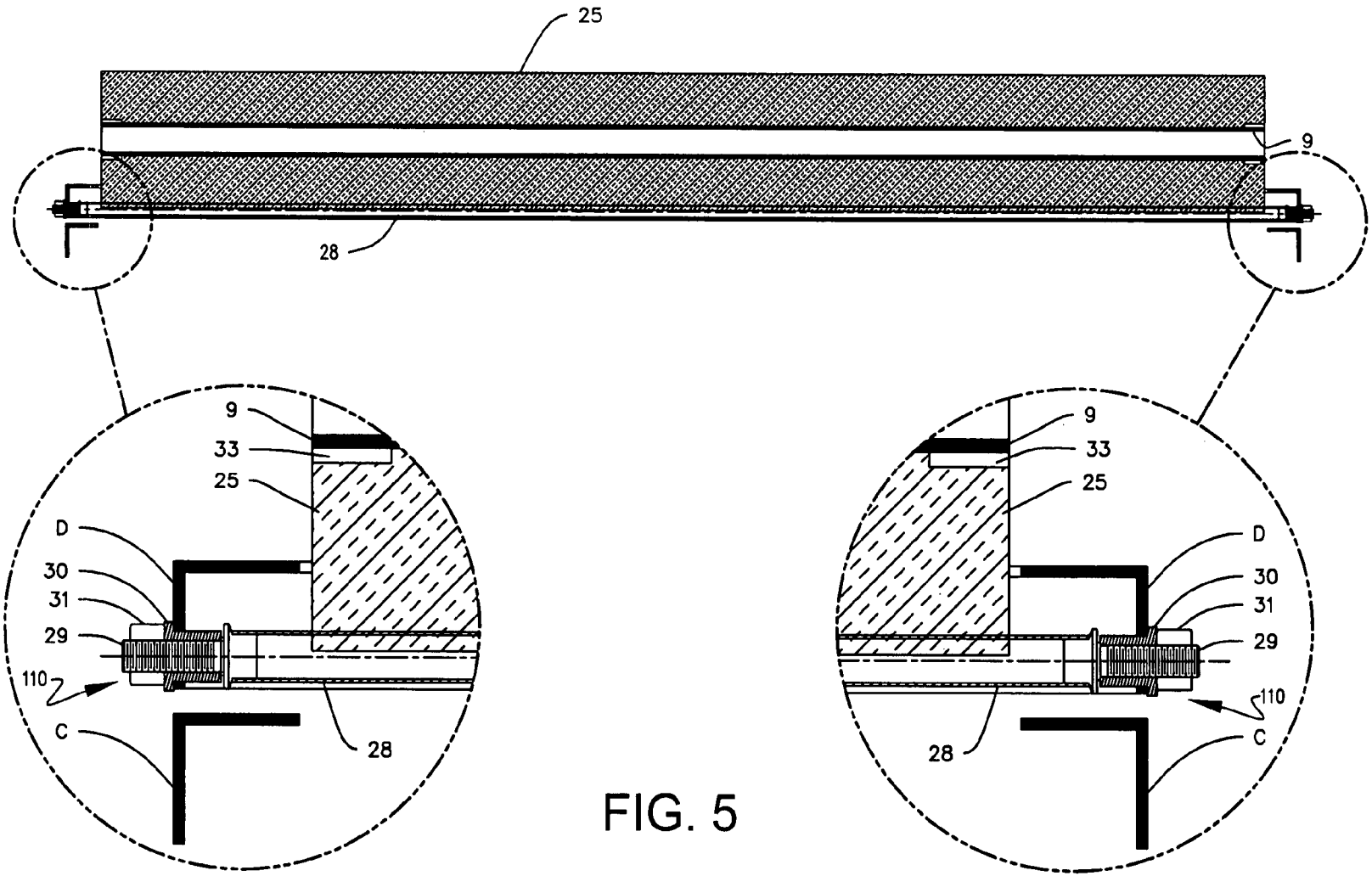
FIG. 5 shows a vertical sectional view of the section 5-5 of FIG. 3.

Looking more closely to FIG. 5, roller shaft assembly 110 preferably comprises roller shaft 28, pilot bearing 29, bushing 30, and pilot bearing nut 31, as shown. Roller shaft 28 of roller shaft assembly 110 is seen preferably supporting mattress pad 25. Preferably, roller shaft 28 comprises a substantially cylindrically shaped member, as shown. Preferably, roller shaft 28 is connected to pilot bearing 29 at both ends allowing free rolling movement for mattress pad 25 as well as providing support, as shown. Preferably, pilot bearing 29 is held in place by a removable fastener, preferably pilot bearing nut 31, as shown, and is kept in alignment by bushing 30, which is placed accordingly in eight places in existing bed frame D, as repeatedly shown in FIG. 1 through FIG. 6. Preferably, bushing 30 is positioned within bed frame D to place the rotational axis of roller shaft 28 (at least embodying herein at least one third axis of rotation) in a substantially parallel alignment with foot portion A and head portion B. Upon reading the teachings of this specification, those of ordinary skill in the art will now understand that, under appropriate circumstances, considering such issues as intended use, cost, etc., other intermediate support arrangements, such as, for example, the use of low-friction panels, ball-and-cup-type supports, etc., may suffice.

Preferably, the operation of motor assembly 15 (at least embodying herein at least one motor-driven rotator) is manually controlled from control panel 32, as shown (at least embodying herein at least one controller adapted to control the operation of such at least one motor-driven rotator). Operation of motor assembly 15 preferably initiates rotation of mattress pad 25 and the linear translation of the upper patient-supporting surface 108 of mattress pad 25, thus moving the patient to a selected resting position. Preferably, motor assembly 15 is adaptable to initiates rotation of mattress pad 25 by driving any one of the plurality of rolling support assemblies described herein (at least embodying herein wherein at least one of such at least one first support, such at least one second support, and such at least one third support is adapted to rotatably drive such at least one essentially continuous loop along at least one path extending substantially between the at least one head portion and the at least one foot portion of the at least one hospital-type bed-frame). Most preferably, motor assembly 15 is operationally coupled to rotate drive shaft 10, as shown (at least embodying herein wherein such at least one motor-driven rotator is adapted to rotatably drive such at least one first rolling support).

Figure 2:
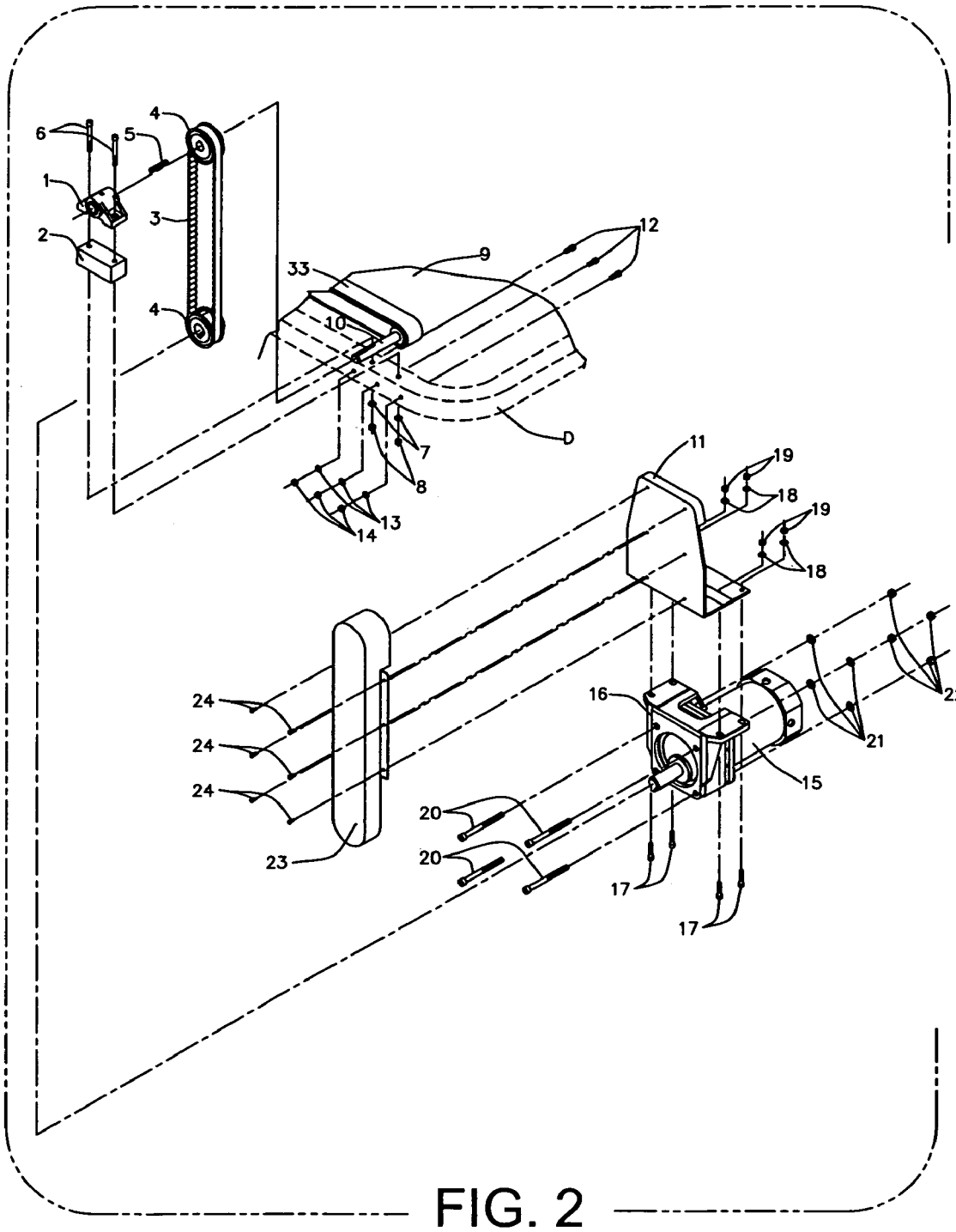
FIG. 2 shows an exploded perspective view of the motor assembly of the preferred embodiment of FIG. 1.

Attention is now directed to FIG. 2 and FIG. 4 to illustrate, in further detail, the preferred assembly of the motor and motor mounting device. Preferably, motor bracket 16 is held in place, to motor 15, by four removable fastener assemblies, preferably comprising four socket head cap screws 20, four washers 21 and four nuts 22, as shown. Preferably, motor bracket 16 is then mounted to support bracket 11 by four removable fastener assemblies, preferably comprising four socket head cap screws 17, four washers 18, and four nuts 19, as shown. Support bracket 11, now preferably supporting motor 15, is then mounted to the existing articulating frame portion D by three removable fastener assemblies, preferably comprising three socket head cap screws 12, three washers 13 and three nuts 14, as shown. Spacer 2 preferably supports bearing pillow block 1 by mounting directly to existing articulating frame portion D with two socket head cap screws 6, two washers 7 and two nuts 8, as shown. Preferably, drive shaft 10 (at least embodying herein at least one first support adapted to support such at least one first loop terminus and at least embodying herein at least one first rolling support) comprises a substantially cylindrically shaped member, as shown. Preferably, drive shaft 10 is placed on pulley 4 and secured against spinning by key 5 that is held in place with a set screw, as shown. Preferably, the second pulley 4 is mounted to motor 15, as shown. Preferably, both pulleys 4 are operationally coupled by drive belt 3, as shown. Preferably, drive belt 3 is adapted to provide a transmission of rotational power between motor 15 and drive shaft 10 (rotation of drive shaft 10 initiating the previously described rotation of endless belt 9). Preferably, protection shroud 23 is mounted to support bracket 11, to protect users from personal injury or harm. Preferably, protection shroud 23 is secured to support bracket 11 by mechanical fasteners, most preferably comprising about six metal screws 24.

Preferably, the entire motor assembly including motor 15 is adapted to move in conjunction with the pivoting movement of existing articulating frame portion D (such as when the frame is adjusted upward and downward). For safety purposes, control panel 32 preferably comprises an operational limiter to limit the operation of motor 15 (and rotation of mattress pad 25) when articulating frame portion D is adjusted from the flat position of FIG. 1 to the raised position of FIG. 7 (at least embodying herein wherein such at least one controller comprises at least one operation limiter adapted to limit the operation of such at least one motor-driven rotator when such at least one hospital-type bed-frame is adjusted to such raised adjusted position). Upon reading the teachings of this specification, those of ordinary skill in the art will now understand that, under appropriate circumstances, considering such issues as intended use, bed design, etc., other operational arrangements, such as, for example, rotating the mattress while the bed is configured in a raised position, adapting the controller to provide limited movement of the mattress when the bed is raised, etc., may suffice.

Figure 3:
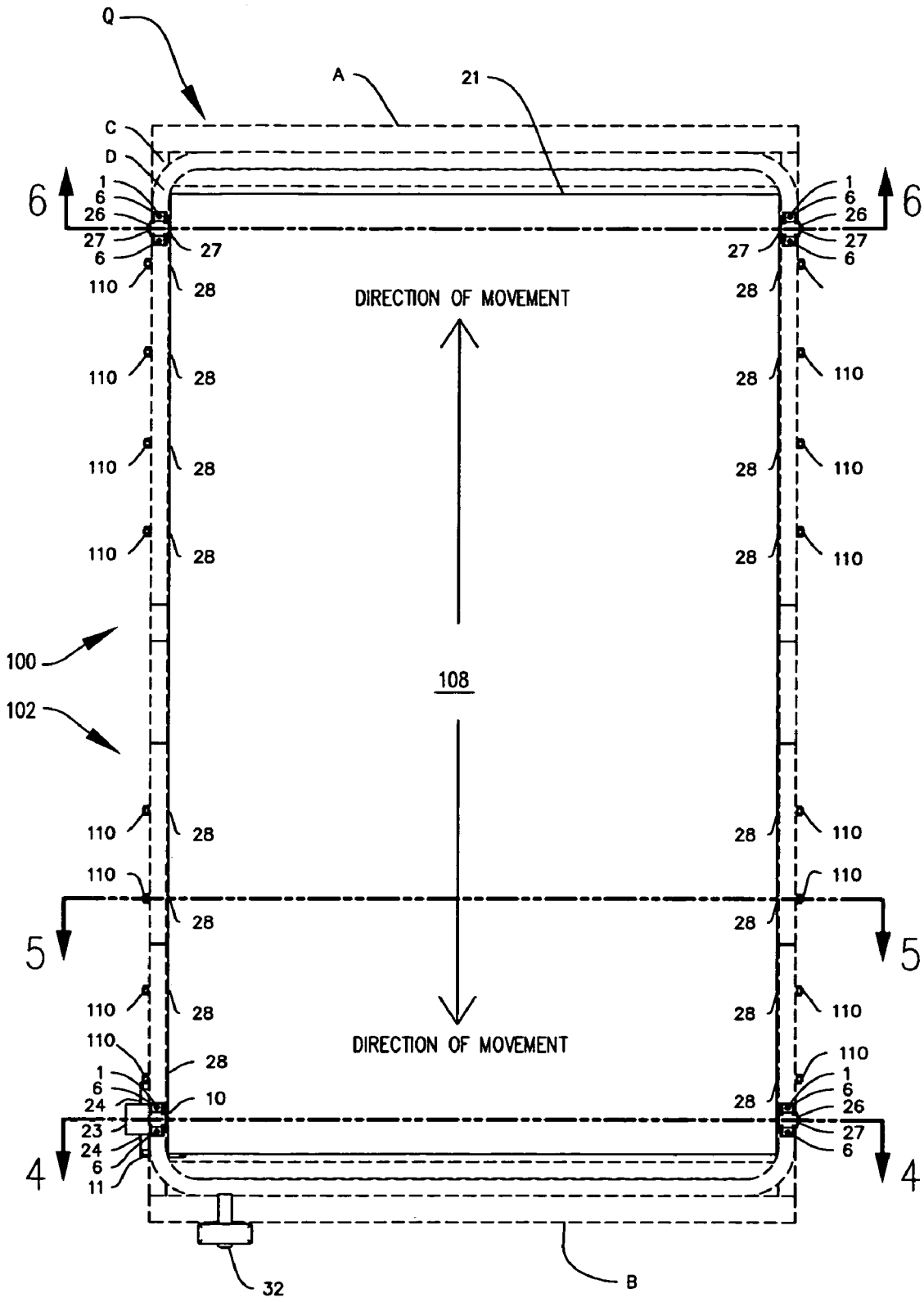
FIG. 3 shows a plan view of the existing hospital bed modified in accordance with the teachings of the invention.

Attention is now directed to FIG. 3, which displays a plan view of existing hospital bed Q indicated by the reference letters A, B, C, and D, modified to comprise patient positioning unit 102 in accordance with the teachings of the present invention. Preferably, each of the above-described support rollers are preferably positioned with their individual axes of rotation aligned transversely to the bed length, i.e., substantially parallel with head portion B and foot portion A, as shown. This preferred configuration allows the continuous loop of mattress pad 25 to move substantially perpendicular to the support rollers, along a linear path extending substantially between head portion B and foot portion A as indicated by the arrow depictions (at least embodying herein wherein at least one of such at least one first rolling support, such at least one second rolling support, and such at least one third rolling support is adapted to rotatably drive such at least one essentially continuous loop along at least one path of movement substantially perpendicular to such at least one second axis of rotation, and such at least one third axis of rotation).

Directing attention to FIG. 4, specifically the encircled detail of the support of drive shaft 10 opposite of motor assembly 15, to keep drive shaft 10 in place inside of pillow block 1, two snap rings 26 are preferably used, as shown. Preferably, spacer 2 supports bearing pillow block 1 by mounting directly to existing bed frame D with two socket head cap screws 6, two washers 7 and two nuts 8, as shown. Preferably, bearing pillow block 1 is mounted to articulating frame portion D to place the rotational axis of drive shaft 10 (at least embodying herein at least one first axis of rotation) in a substantially parallel alignment with foot portion A and head portion B, as shown.

Figure 6:
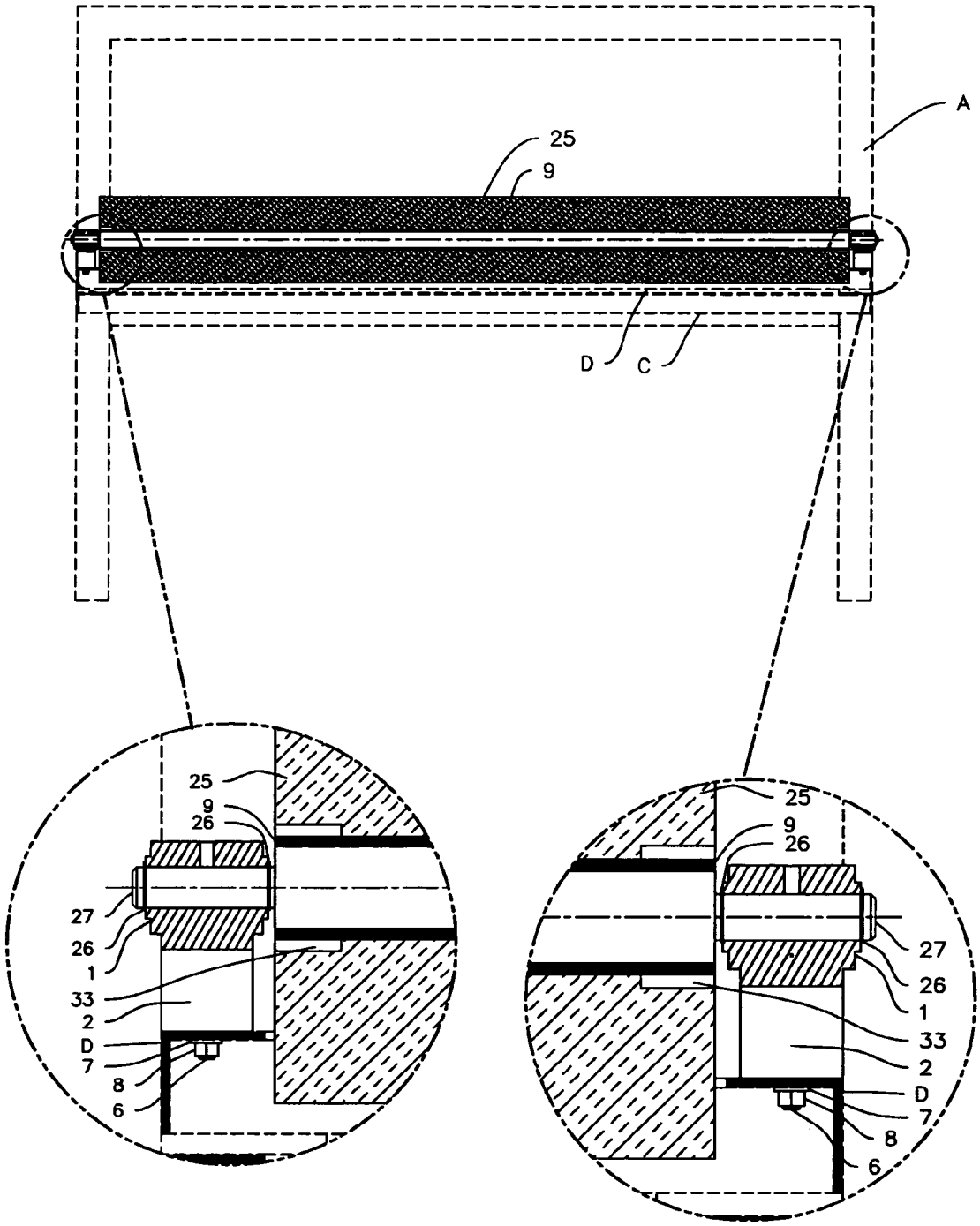
FIG. 6 shows a vertical sectional view of the section 6-6 of FIG. 3.

Directing attention to FIG. 6, specifically the encircled details of the support of the bearing shaft 27 on both ends, preferably bearing shaft is symmetrical in design as can be seen in the details. Preferably, to maintain bearing shaft 27 in place inside of pillow block 1, two snap rings 26 are used, as shown. Preferably, spacer 2 is adapted to support bearing pillow block 1 by mounting directly to existing bed frame D with two socket head cap screws 6, two washers 7 and two nuts 8, as shown.

Figure 7:
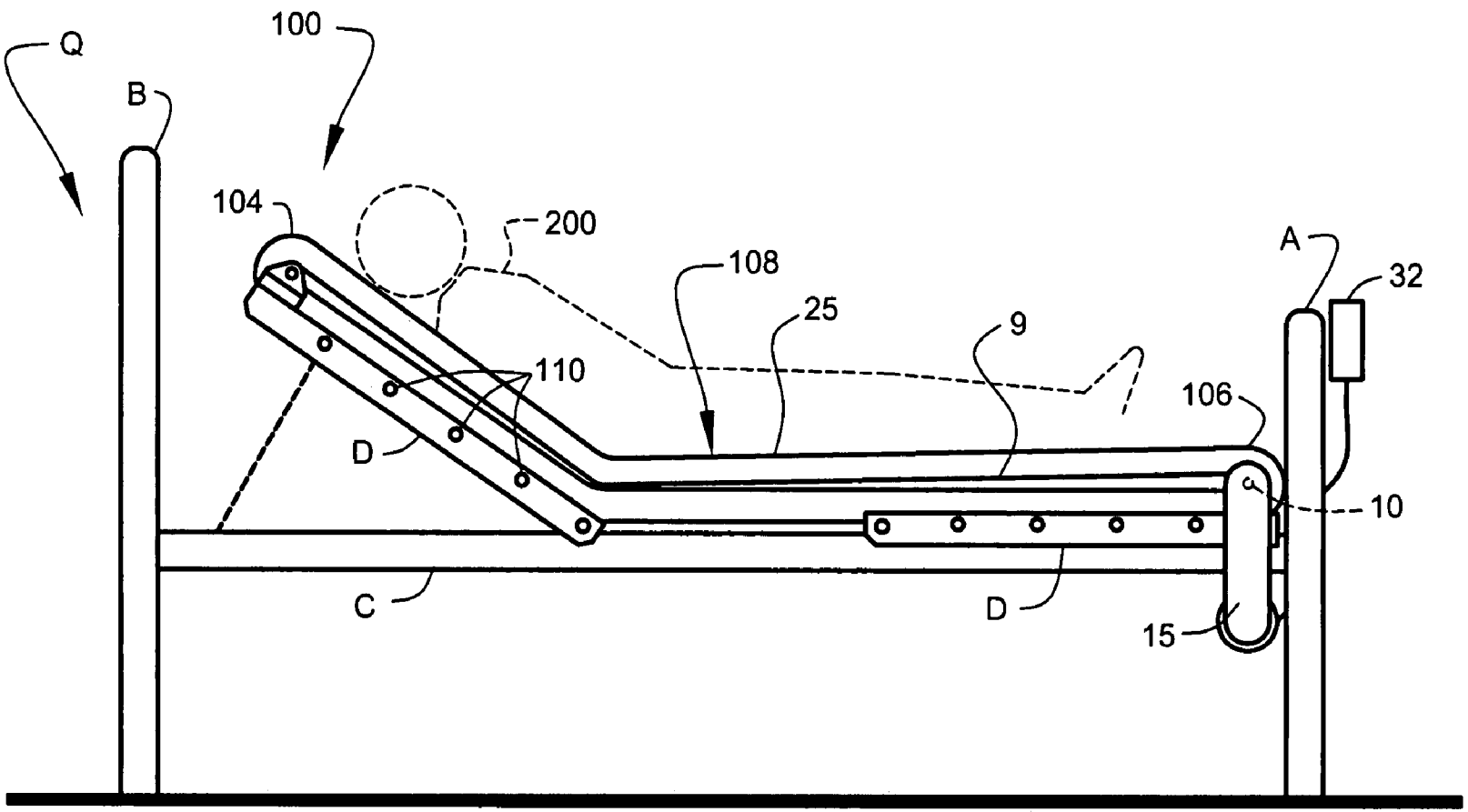
FIG. 7 shows a side view of a hospital bed comprising the patient positioning unit adjusted to an inclined position, according to a preferred embodiment of the present invention.

FIG. 7 is a side view of hospital bed Q comprising patient positioning unit 102, adjusted to an inclined position, according to a preferred embodiment of the present invention. Hospital bed system 100 is especially useful in maneuvering an individual to a position within hospital bed Q that allows the adjusted articulation of frame portions D. It should be noted that preferred embodiments of patient positioning unit 102 comprise an alternate preferred location of control panel 32, drive shaft 10, and motor 15 adjacent foot portion A, as shown. Upon reading the teachings of this specification, those of ordinary skill in the art will now understand that, under appropriate circumstances, considering such issues as intended use, user preference, etc., other controller arrangements, such as, for example, providing multiple control points utilizing multiple controllers, providing automatically actuated controls, wireless remote control apparatus, etc., may suffice.

In preferred operation, an individual 200 resting on patient-supporting surface 108 of mattress pad 25 is repositioned by operating control panel 32 located at foot portion A, as shown. Preferably, motor 15 slowly turns drive shaft 10 that is operationally coupled with endless belt 9 and mattress pad 25. The translational movement of patient-supporting surface 108 by the rotation of mattress pad 25 moves the supported individual toward head portion B (or foot portion A as selected) of hospital bed Q.

The fitting of patient positioning unit 102 to hospital bed Q greatly reduces the physical pulling or tugging to which the bed-ridden individual is typically subjected. In addition, upon reading the teachings of this specification, those of ordinary skill in the art will now appreciate that use of patient positioning unit 102 greatly reduces the potential for injuries and stress to which the caregiver is otherwise subjected.

Thus, in accordance with preferred embodiments of the present invention, there is provided, a method, related to mechanically-assisted movement of at least one individual supported upon at least one hospital-type bed-frame having at least one head portion B, at least one foot portion A, and at least one intermediate portion therebetween, preferably comprising the steps of:

providing at least one resilient pad (mattress pad 25) adapted to comfortably support the at least one individual; arranging such at least one resilient pad to comprises at least one essentially continuous loop having at least one first loop terminus 104 adapted to reside adjacent the at least one head portion B and at least one second loop terminus 106 adapted to reside adjacent the at least one foot portion A; providing at least one first support (drive shaft 10) adapted to support such at least one first loop terminus 104; providing at least one second support (bearing shaft 27) adapted to support such at least one second loop terminus; and providing at least one third support (roller shaft assembly 110) adapted to support such at least one resilient pad (mattress pad 25) adjacent the at least one intermediate portion. In addition, it comprises the preferred steps of mounting each of such at least one first support, such at least one second support, and such at least one third support to the at least one hospital-type bed-frame; providing at least one motor-driven rotator adapted to rotatably drive at least one of such at least one first support, such at least one second support, and such at least one third support; and using such motor-driven rotator to rotate at least one of such at least one first support, such at least one second support, and such at least one third support to rotatably drive such at least one essentially continuous loop along at least one path extending substantially between the at least one head portion and the at least one foot portion of the at least one hospital-type bed-frame; wherein such at least one essentially continuous loop while rotatably driven is adapted to provide such mechanically-assisted movement of at least one individual supported upon such at least one hospital-type bed-frame.

Even further, it provides such a method further comprising the step of providing at least one controller adapted to control the operation of such at least one motor-driven rotator. Even further, it provides such a method further comprising the initial step of providing at least one the at least one hospital-type bed comprising the at least one hospital-type bed-frame.

Although applicant has described applicant's preferred embodiments of this invention, it will be understood that the broadest scope of this invention includes modifications such as diverse shapes, sizes, and materials. Such scope is limited only by the below claims as read in connection with the above specification.

Further, many other advantages of applicant's invention will be apparent to those skilled in the art from the above descriptions and the below claims.

What is claimed is:

1. A system, related to mechanically-assisted movement of at least one individual supported upon at least one hospital-type bed-frame having at least one head portion, at least one foot portion, and at least one intermediate portion, said system comprising:

a) at least one resilient pad adapted to comfortably support the at least one individual;

b) wherein said at least one resilient pad comprises at least one essentially continuous loop having at least one first loop terminus adapted to reside adjacent the at least one head portion and at least one second loop terminus adapted to reside adjacent the at least one foot portion;

c) at least one first support adapted to support said at least one first loop terminus;

d) at least one second support adapted to support said at least one second loop terminus;

e) at least one third support adapted to support said at least one resilient pad adjacent the at least one intermediate portion;

f) wherein at least one of said at least one first support, said at least one second support, and said at least one third support is adapted to rotatably drive said at least one essentially continuous loop along at least one path extending substantially between the at least one head portion and the at least one foot portion of the at least one hospital-type bed-frame;

g) at least one essentially endless belt adapted to fit within said at least one essentially continuous loop of said at least one resilient pad; and h) at least one removable attacher adapted to removably attach said at least one resilient pad to said at least one essentially endless belt;

i) wherein said at least one essentially endless belt is adapted to movably engage said at least one first support and said at least one second support.

2. The system according to claim 1 further comprising:

a) at least one motor-driven rotator adapted to rotatably drive at least one of said at least one first support, said at least one second support, and said at least one third support; and b) at least one controller adapted to control the operation of said at least one motor-driven rotator.

3. The system according to claim 1 wherein:

a) said at least one first support comprises at least one first rolling support adapted to rotatably support said at least one first loop terminus; and b) said at least one second support comprises at least one second rolling support adapted to rotatably support said at least one second loop terminus.

4. The system according to claim 3 wherein said at least one third support comprises at least one third rolling support adapted to rotationally support said at least one resilient pad.

5. The system according to claim 4 wherein:

a) said at least one first rolling support, said at least one second rolling support, and said at least one third rolling support each comprise at least one substantially cylindrical member having at least one first end and at least one second end;

b) said at least one first end and said at least one second end each comprise at least one bearing adapted to provide rotatable support of said at least one substantially cylindrical member; and c) said at least one bearing is adapted to be rigidly mountable to the at least one hospital-type bed-frame.

6. The system according to claim 1 wherein said at least one essentially endless belt comprises at least one width and at least one length substantially matching that of said at least one essentially continuous loop.

7. The system according to claim 2 further comprising:

a) at least one hospital-type bed comprising such at least one hospital-type bed-frame;

b) wherein said at least one hospital-type bed-frame comprises at least one adjustable articulation having at least one raised adjusted position and at least one lowered adjusted position.

8. The system according to claim 7 wherein said at least one controller comprises at least one operation limiter adapted to limit the operation of said at least one motor-driven rotator when said at least one hospital-type bed-frame is adjusted to such raised adjusted position.

9. The system according to claim 7 wherein said at least one controller comprises at least one manual control adapted to provide manual control of said at least one motor-driven rotator.

10. A system, related to mechanically-assisted movement of at least one individual supported upon at least one hospital-type bed-frame having at least one substantially rectangular-shaped periphery comprising least one head portion, at least one foot portion, and at least one intermediate portion extending there between, said system comprising:

a) at least one resilient pad adapted to comfortably support the at least one individual;

b) wherein said at least one resilient pad comprises at least one essentially continuous loop having at least one first loop terminus adapted to reside adjacent the at least one head portion and at least one second loop terminus adapted to reside adjacent the at least one foot portion;

c) at least one first rolling support, having at least one first axis of rotation, adapted to rotatably support said at least one first loop terminus;

d) at least one second rolling support, having at least one second axis of rotation, adapted to rotatably support said at least one second loop terminus; and e) at least one third rolling support, having at least one third axis of rotation, adapted to rotationally support said at least one resilient pad adjacent the at least one intermediate portion;

f) wherein said at least one first axis of rotation, said at least one second axis of rotation, and said at least one third axis of rotation are aligned substantially parallel with the at least one head portion and the at least one foot portion of the at least one substantially rectangular-shape periphery;

g) wherein at least one of said at least one first rolling support, said at least one second rolling support, and said at least one third rolling support is adapted to rotatably drive said at least one essentially continuous loop along at least one path of movement substantially perpendicular to said at least one second axis of rotation, and said at least one third axis of rotation;

h) at least one essentially endless belt adapted to operate within the at least one essentially continuous loop of said at least one resilient pad; and i) at least one removable attacher adapted to removably attach said at least one resilient pad to said at least one essentially endless belt;

j) wherein said at least one essentially endless belt is adapted to directly engage said at least one first rolling support and said at least one second rolling support.

11. The system according to claim 10 further comprising:

a) at least one motor-driven rotator adapted to rotatably drive at least one of at least one of said at least one first rolling support, said at least one second rolling support, and said at least one third rolling support; and b) at least one controller adapted to control the operation of said at least one motor-driven rotator;

c) wherein said at least one controller comprises at least one manual control adapted to provide manual control of said at least one motor-driven rotator.

12. The system according to claim 11 wherein said at least one motor-driven rotator is adapted to rotatably drive said at least one first rolling support.

13. The system according to claim 10 wherein:

a) said at least one first rolling support, said at least one second rolling support, and said at least one third rolling support each comprise at least one substantially cylindrical member having at least one first end and at least one second end;

b) said at least one first end and said at least one second end each comprise at least one bearing adapted to provide free rotation of said at least one substantially cylindrical member; and c) said at least one bearing is adapted to be mountable to the at least one hospital-type bed-frame.

14. The system according to claim 10 further comprising:

a) such at least one hospital-type bed comprising at least one hospital-type bed-frame;

b) wherein said at least one hospital-type bed-frame comprises such at least one head portion, such at least one foot portion, and such at least one intermediate portion; and c) wherein said at least one hospital-type bed-frame comprises at least one adjustable articulation having at least one raised adjusted position and at least one lowered adjusted position.

15. The system according to claim 14 wherein said at least one controller comprises at least one operation limiter adapted to limit the operation of said at least one motor-driven rotator when said at least one hospital-type bed-frame comprises such at least one raised configuration.

16. A method, related to mechanically-assisted movement of at least one individual supported upon at least one hospital-type bed-frame having at least one head portion, at least one foot portion, and at least one intermediate portion, comprising the steps of:

a) providing at least one resilient pad adapted to comfortably support the at least one individual b) arranging such at least one resilient pad to comprises at least one essentially continuous loop having at least one first loop terminus adapted to reside adjacent the at least one head portion and at least one second loop terminus adapted to reside adjacent the at least one foot portion;

c) providing at least one first support adapted to support such at least one first loop terminus;

d) providing at least one second support adapted to support such at least one second loop terminus;

e) providing at least one third support adapted to support such at least one resilient pad adjacent the at least one intermediate portion;

f) mounting each of such at least one first support, such at least one second support, and such at least one third support to the at least one hospital-type bed-frame;

g) providing at least one rotator drive adapted to rotatably drive at least one of said at least one first support, said at least one second support, and said at least one third support; and h) using such rotator drive to rotate at least one of such at least one first support, such at least one second support, and such at least one third support to rotatably drive such at least one essentially continuous loop along at least one path extending substantially between the at least one head portion and the at least one foot portion of the at least one hospital-type bed-frame;

i) wherein such at least one essentially continuous loop while rotatably driven is adapted to provide such mechanically-assisted movement of at least one individual supported upon such at least one hospital-type bed-frame;

j) providing at least one essentially endless belt adapted to fit within said at least one essentially continuous loop of said at least one resilient pad; and k) providing at least one removable attacher adapted to removably attach said at least one resilient pad to said at least one essentially endless belt;

l) wherein said at least one essentially endless belt is adapted to movably engage said at least one first support and said at least one second support.

17. The method according to claim 16 further comprising the step of providing at least one motor and at least one controller adapted to control the operation of said at least one rotator drive.

18. The method according to claim 16 further comprising the initial step of providing at least one such at least one hospital-type bed comprising the at least one hospital-type bed-frame.

* * * * *